US007784789B2

(12) United States Patent
Holsten et al.

(10) Patent No.: US 7,784,789 B2
(45) Date of Patent: Aug. 31, 2010

(54) WHEEL SPINNING SURPRISE WATER GAME

(76) Inventors: William A. Holsten, 16 Twin Oaks Rd., Parsippany, NJ (US) 07054; Janet Holsten, 16 Twin Oaks Rd., Parsippany, NJ (US) 07054

( * ) Notice: Subject to any disclaimer, the term of this patent is extended or adjusted under 35 U.S.C. 154(b) by 0 days.

(21) Appl. No.: 12/269,776

(22) Filed: Nov. 12, 2008

(65) Prior Publication Data

US 2009/0121426 A1 May 14, 2009

Related U.S. Application Data

(60) Provisional application No. 61/002,915, filed on Nov. 13, 2007.

(51) Int. Cl.
*A63B 71/00* (2006.01)

(52) U.S. Cl. ..... 273/138.1

(58) Field of Classification Search ..... 273/138.1
See application file for complete search history.

(56) References Cited

U.S. PATENT DOCUMENTS 3,202,318 A * 8/1965 Black ..... 239/72
3,477,723 A * 11/1969 Djedda ..... 273/349
4,113,259 A * 9/1978 Sands ..... 273/241
4,239,129 A * 12/1980 Esposito ..... 222/79
D297,748 S * 9/1988 Marino ..... D21/572
5,435,569 A * 7/1995 Zilliox ..... 273/349
5,662,525 A * 9/1997 Briggs ..... 472/128
5,820,471 A * 10/1998 Briggs ..... 472/128
5,865,438 A * 2/1999 Zilliox ..... 273/349
5,887,796 A * 3/1999 Dimmer ..... 239/444
6,250,636 B1 * 6/2001 Rivet et al. ..... 273/457

* cited by examiner

*Primary Examiner*—Gene Kim
*Assistant Examiner*—Dolores Collins
(74) *Attorney, Agent, or Firm*—Edwin Tarver; Lauson & Tarver, LLP

(57) ABSTRACT

A chance-based water game for randomly spraying none, one or multiple individual players includes a housing with an inlet for a pressurized water source; a disc-shaped selector, and a trigger. The housing also comprises a series of tubes and nozzles for directing the pressurized water at the players. The trigger is connected to a valve for permitting a predetermined amount of pressurized water to pass through the device. When the trigger is activated, water travels from the pressure source, into the housing, past the trigger valve, and into a manifold where the single stream of water is channeled through a valve and gasket to none, one or multiple individual circuits corresponding to none, one or multiple nozzles. The selector determines the circuits, if any, through which the water passes.

19 Claims, 3 Drawing Sheets

WHEEL SPINNING SURPRISE WATER GAME

CROSS-REFERENCE TO RELATED APPLICATION

This application claims the benefit of the priority date of provisional application No. 61/002,915, filed on Nov. 13, 2007.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates to water games, and more specifically to a chance-based water game wherein players spin a selector and activate a trigger once the selector comes to rest. Depending on the position of the selector, none, one or multiple players will be individually sprayed through nozzles extending from the game. Another object of the present invention is to provide a connection for a pressurized water supply. Another object of the invention is to provide a trigger that allows a specific amount of water through the device each time the trigger is activated. Another object of the invention is to provide a manifold associated with the selector for randomly transmitting water to none, one or more players depending on the position of the selector. These and other objects will become apparent from the appended summary, description and claims.

SUMMARY

The present invention comprises a chance based water game for randomly wetting players. The device comprises a main housing with a pressurized water supply inlet and a series of water circuits or water spouts. Each circuit further comprises tubes that rise above the players, each one terminating at a nozzle aimed at an individual player. A unique identifier can be included to identify specific nozzles.

A selector is disposed on the housing for randomly selecting a plurality of settings. The selector causes the device to randomly associate the water supply with one or more circuits. The selector is activated by a player, and is biased to stop randomly in a position corresponding to water traveling through none, one, or more spouts. The selector is disc-shaped and capable of spinning in multiple rotations when set in motion. The selector can contain indicia, and the indicia may or may not correspond to the positions of the players. A trigger is disposed on the housing and is associated with the water supply. The trigger releases a predetermined quantity of water. The trigger can be a pivoting member related to a diaphragm valve.

On the interior of the device, a manifold comprising a movable valve and gasket controls the flow of water. The manifold splits a single stream of upstream water into one of a series or multiple downstream water channels and has multiple settings, including preventing the water from reaching any downstream channels. The manifold is located downstream from the water source and trigger.

Inside the manifold a cylindrical chamber has an entrance, and a plurality of exits leading to the various circuits of the device. A disc shaped valve plate disposed in the chamber is adjacent the exits. The valve plate is attached to an axle traveling from a lower journal in the chamber through the valve plate and an upper journal, to the selector. A circlip holds the axle in position when the device is under pressure. A valve gasket seals the valve plate against the exits, and in certain embodiments a weeper hole may permit water to exit the device when not in use, although the use of a weeper hole is not mandatory.

When the exits of manifold align with a portal in the valve plate, water enters the circuits of the device. If the portal doesn't align with the exits of the manifold, the water is prevented from entering the circuits. The manifold and holes are along the same axis so that the portal can align with one of the holes or simply against the flat surface of the top of the manifold. Two types of valve plates is shown and described. The first type valve plate comprises a series of holes that correspond to one or multiple downstream circuits of water.

In this manner, if the portal lines up with a hole connected to one circuit, one player will be sprayed, while the other player or players remain dry. If the portal aligns with the other player's corresponding manifold hole, the first player will be sprayed. If the portal aligns with a hole connecting to both circuits, both or a combination of multiple players will be sprayed. And if the portal aligns with the top surface of the manifold, no water will exit the device. Although this embodiment is illustrative, it is anticipated that more than two combinations of players are possible in various alternative embodiments of the invention.

To use the device of the present invention, players are disposed so that the circuits aim at their persons. Pressurized water is than provided from an external source and connected to the housing. A player or players activate the selector; by spinning a selector disc in a preferred embodiment. The selector is biased to randomly stop at one of a plurality of positions correlating to a circuit of water over none, one or multiple players. Once the selector stops, the trigger is activated, allowing a predetermined amount of water to travel into the manifold and through none, one or multiple circuits, potentially soaking a player or players.

In addition to the seated version of the game, a standing version of the game has showers for casting water over standing players extending from a base on which the players stand. The players activate a selector and once it comes to rest each player activates a trigger associated with that player's shower. When the trigger is activated, water flows through none, one, or multiple circuits.

DETAILED DESCRIPTION

Figure 1:
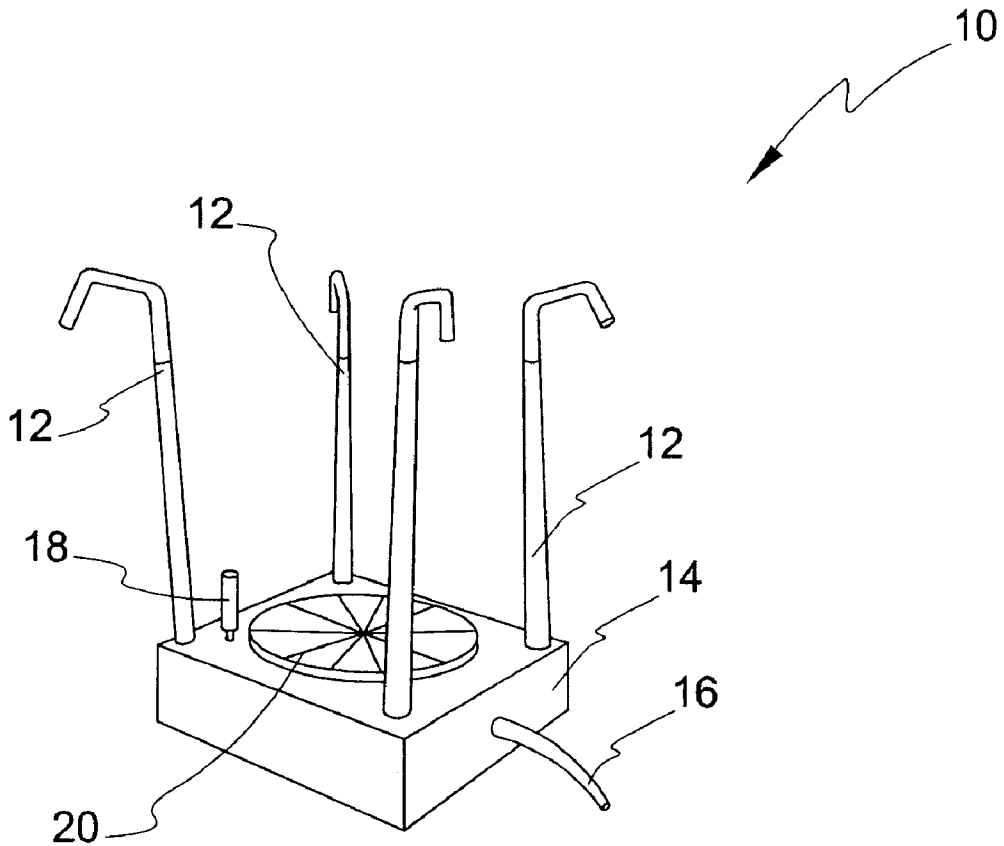
FIG. 1 is an external perspective view of the present invention.

Referring to FIG. 1, the present invention comprises a chance based water game device for randomly wetting players. The device 10 comprises a main housing 14 with an inlet into which a water supply 16 capable of transmitting a predetermined or continuous quantity of water under a predetermined pressure into the main housing 14. In an alternate embodiment, a means for keeping score is disposed on the housing. In another embodiment, the means for keeping score comprises an "X" shaped stabilizer, connected to a series of shower heads. The stabilizer is preferably made of a resilient material including Lucite.

The exterior of the main housing 14 comprises a series of channels or circuits 12. Each circuit further comprises a means for directing a quantity of water onto the person of a player. In one preferred embodiment, the circuits 12, comprise independent tubes that rise substantially vertically from the main housing 14, terminating in nozzles aimed at the respective positions of the players. In another preferred embodiment, each exit bears unique indicia. In another preferred embodiment, the device comprises four circuits.

The exterior of the main housing 14 further comprises a means 20 for randomly selecting a plurality of settings ("selector"). The selector 20 causes the device 10 to randomly associate the water supply 16 with one or more circuits 12. The selector 20 is activated by a player or players, and further comprises means for stopping randomly. In a preferred embodiment, the selector 20 comprises a discus capable of spinning relative to a central axis. In another embodiment, the selector is biased to stop in one of a variety of positions by a series of raised members that correspond to a series of grooves between the housing and selector. In a further embodiment, the discus further comprises indicia, and in yet another embodiment the indicia may correlate to the circuits to indicate the direction of water flow. The selector is capable of multiple rotations in either direction.

The exterior of the main housing 14 further comprises a means 18 for constraining and releasing a predetermined quantity of water ("trigger"). In one preferred embodiment, the trigger 18 comprises a handle on the exterior of the housing 14, wherein the handle is connected to a means for constraining and releasing water on the interior of the housing 14. In a further preferred embodiment, the trigger comprises a pivoting member related to a valve, including a diaphragm valve. In one exemplary embodiment a valve from a conventional commercial urinal is used.

Figure 2:
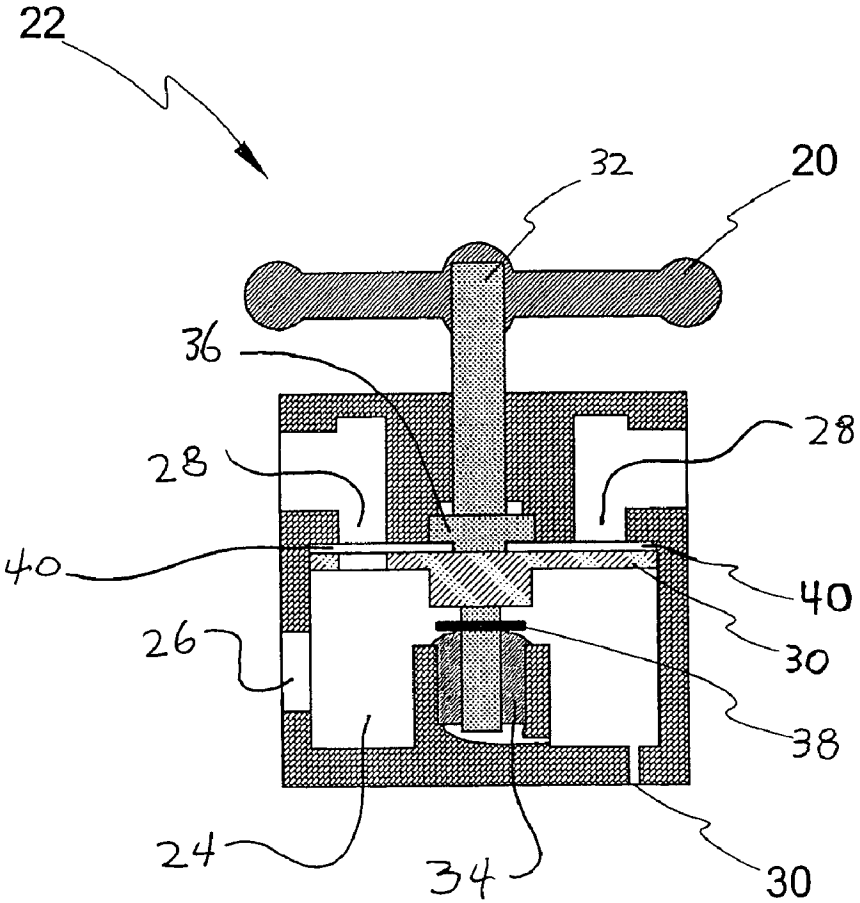
FIG. 2 is a cut away view of the water manifold of the present invention.

Referring to FIG. 2, on the interior of the device 10, one embodiment of a movable valve and gasket means 22 for controlling the flow of water ("manifold") is shown and described. The manifold can be any device capable of splitting a single stream of upstream water into one of a series or multiple downstream water channels; and capable of multiple settings, including preventing the water from reaching any downstream channels. The manifold is disposed serially downstream from the water source and trigger.

In the exemplary embodiment, the manifold 22 comprises a cylindrical chamber 24 with an entrance 26, and a plurality of exits 28 leading to the various circuits of the device. A disc shaped valve plate 30 is disposed in the chamber 24 adjacent the exits 28. The valve plate is attached to an axle 32, which travels from a lower journal 34 in the chamber 24, through the valve plate 30 and an upper journal 36, to the selector 20. In one preferred embodiment, a circlip 38 holds the axle 32 in vertical position. In another preferred embodiment, a valve gasket 40 seals the valve plate 30 against the exits 28. In another preferred embodiment, a weeper hole 42 perm its water to exit the device when not in use.

Figure 3:
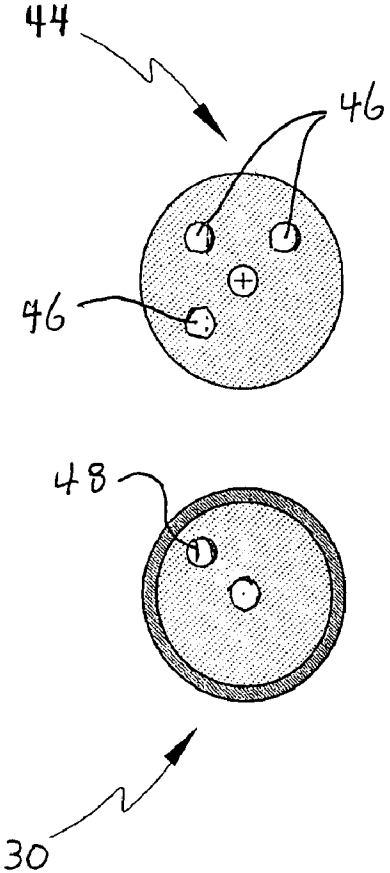
FIG. 3 is a plan view of the bottom of the water manifold and rotating valve of the present invention.

Referring to FIG. 3, a detail of one embodiment of the manifold holes and valve is shown and described. In this embodiment, the top of the manifold 44 comprises a series of holes 46 which may lead to individual or multiple circuits. The valve plate 30 comprises a portal 48, through which water can pass. The valve plate 30 spins relative to the top of the manifold 44 along the same axis so that the portal 48 can align with one of the holes 46 or simply against the flat surface of the top of the manifold. Two types of valve plates are possible, a first type with a single portal and a second type with multiple portals.

In this manner, if the portal lines up with a hole connected to one circuit, one player will be sprayed, while the other player remains dry. If the portal aligns with the other player's corresponding manifold hole, the first player will be sprayed. If the portal aligns with a hole connecting to both circuits, both players will be sprayed. And if the portal aligns with the top surface of the manifold, no water will exit the device. Although this embodiment is illustrative, it is anticipated that more than two combinations of players are possible in various alternative embodiments of the invention.

To use the device of the present invention, players are disposed so that the circuits aim at their persons. Pressurized water is than provided from an external source and connected to the housing. A player or players activate the selector; by spinning a selector disc in a preferred embodiment. The selector is biased to randomly stop at one of a plurality of positions correlating to a circuit of water over none, one or multiple players. Once the selector stops, the trigger is activated, allowing a predetermined amount of water to travel into the manifold and through none, one or multiple circuits, potentially soaking a player or players.

Figure 4:
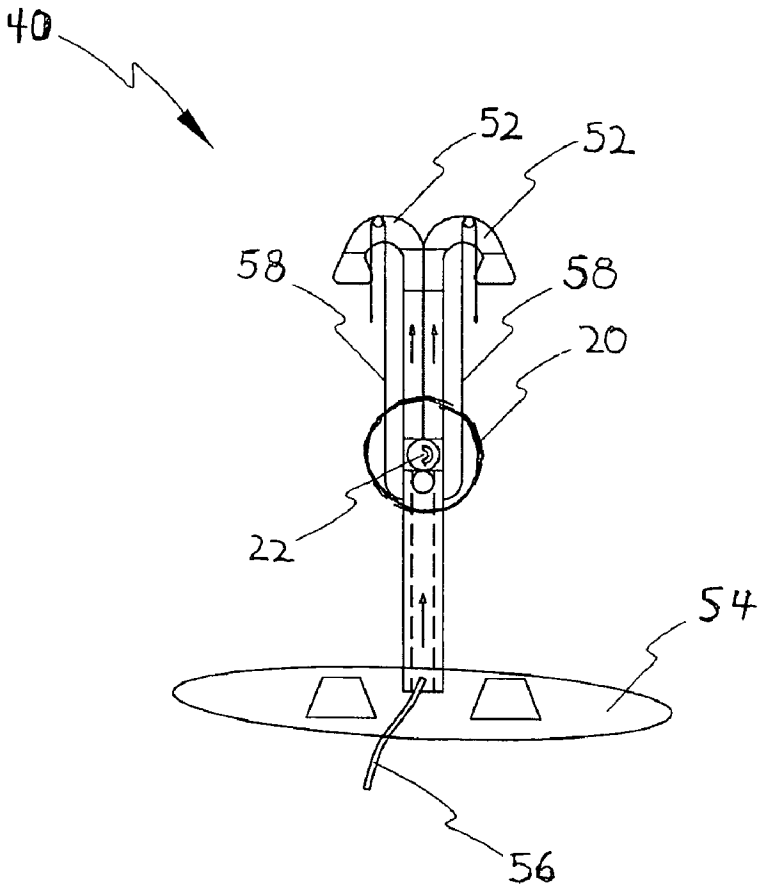
FIG. 4 is a side view of an alternative version of the invention for standing players.

Referring to FIG. 4, a standing version of the game is shown and described. The standing device 50 comprises showering means 52 for casting water over a standing player ("showers") extending from a base 54 on which players can stand. In one preferred embodiment of this version of the invention, the players activate a selector 20 connected to the manifold 22 to cause the device 50 to select the player or players to be soaked at random, including no players. The water supply for this version of the game is preferably, but not necessarily connected to the bottom of the showers.

In a preferred embodiment of the standing version of the game, each player has an activating means ("trigger") associated with that player's shower. When the trigger is activated, water is permitted to flow through the circuits designated by the position of the selector on the manifold. In one preferred embodiment, the trigger comprises a cord type activator 58 to resemble an antique shower.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A chance based water game device for wetting players, comprising a. a valve means for releasing a predetermined quantity of pressurized water:

b. a game housing, comprising a water inlet associated with the valve means, a movable valve and gasket means connected to the water inlet for alternatively preventing or allowing water to flow into one or more of a series of channels in a manifold means for routing water to a series of circuits associated with the channels, and means for causing the valve and gasket means to randomly come to rest so that water travels through an exit when set in motion and released:

c. a transferring means for transferring water from each circuit to a random number of exits, including none wherein the exits are disposed so as to transport water from the transferring means onto players playing the game; and d. a handle means for allowing players to set the valve and gasket means in motion.

2. The device of claim 1, wherein each of the exits is separately identifiable by indicia.

3. The device of claim 2, wherein the device comprises means for scoring, according to the number of times water travels through individual exits.

4. The device of claim 1, wherein the means for setting the valve and gasket means in motion comprises a disc that players can spin.

5. The device of claim 1, wherein the exits comprise four spouts that extend from the housing up and over four seated players.

6. The device of claim 1, wherein an alternate embodiment disposes exits comprising two or more spouts that extend from the housing over two or more standing players.

7. The device of claim 1, wherein each exit is associated with means for releasing a predetermined quantity of water.

8. The device of claim 1, wherein a single releasing means for all exits is disposed on the housing.

9. The device of claim 1, wherein the housing has a weep hole for releasing water.

10. The device of claim 1, wherein an axle connects the handle means to the valve and gasket means.

11. The device of claim 1, wherein a circlip holds an axle in the valve of the valve and gasket in position permitting rotational movement.

12. The device of claim 1, wherein circuits are provided for releasing water to one or multiple spouts.

13. The device of claim 1, wherein the means of causing the valve and gasket means to come to rest comprises means for randomly aligning the valve with one of a series of channels in the manifold.

14. The device of claim 13, wherein the alignment means comprises a series of raised members on the housing that correspond to a series of grooves on the valve and gasket.

15. The device of claim 1, wherein the valve and gasket means comprises a disc with a portal.

16. The device of claim 1, wherein the valve and gasket means can cause the valve to pass all of the channels of the manifold at least once prior to coming to rest in either direction.

17. The device of claim 16, wherein the handle means, has sufficient mass to cause the valve and gasket to pass all of the channels of the manifold at least once prior to coming to rest when moved and released by hand.

18. A chance based water game device for wetting players, comprising a. a trigger for releasing a predetermined quantity of pressurized water:

b. a game housing, comprising a water inlet connected to the trigger, a rotating valve and gasket atop a chamber connected to the water inlet, which alternately prevents or allows water to enter one of a series of chambers in a manifold connected to one or more water tubes, and a selector that causes the valve and gasket to randomly come to rest so that water travels from the chamber, through the gasket, and into a manifold chamber when set in motion and released:

c. the water tubes transferring water from each manifold chamber to none, one or more spouts, wherein the spouts randomly release water to soak one or more players; and d. a scoring system to determine the number of times an individual player has been soaked.

19. A method of playing a chance based water game device for wetting players comprising the steps of:

a. at least two players disposing themselves near or under at least two water spouts;

b. each player, in turn, spinning a controller connected to a housing, wherein the handle causes a manifold in the housing to align with one or more circuits, permitting water to pass through to none, one or more of the spouts:

c. once the handle and valve and gasket come to rest, aligned with a random manifold chamber, one or more of the players activating one or more triggering mechanisms releasing a predetermined quantity of pressurized water through the valve and gasket, through the randomly selected manifold chamber, through the spouts connected to the chamber, and onto none, one or more players; and d. using a scoring system to keep track of how many times each player has been soaked.

* * * * *